US005324220A

United States Patent [19]

Stewart

[11] Patent Number: 5,324,220

[45] Date of Patent: Jun. 28, 1994

[54] AQUATIC BODYBOARD LEASH

[76] Inventor: Michael Stewart, 6915 Shorecrest Dr., Anaheim, Calif. 92802

[21] Appl. No.: 852,819

[22] Filed: Mar. 17, 1992

[51] Int. Cl.[5] ..... B63B 35/79

[52] U.S. Cl. ..... 441/75; 119/770; 119/798

[58] Field of Search ..... 441/75, 74, 85; 191/12 R; 119/96; 267/167, 182; 174/69

[56] References Cited

U.S. PATENT DOCUMENTS

| | | | |
|---|---|---|---|
| D. 303,278 | 9/1989 | Nealy | D21/238 |
| 2,911,947 | 11/1959 | Kramer | 119/109 |
| 2,994,300 | 8/1961 | Grahling | 119/96 |
| 3,003,018 | 10/1961 | Cook | 174/69 |
| 3,216,030 | 9/1965 | Garfield | 441/84 |
| 3,397,482 | 8/1968 | Bibeau et al. | 119/96 |
| 4,041,562 | 8/1977 | Nealy | 441/75 |
| 4,044,415 | 8/1977 | Wood | 441/75 |
| 4,285,083 | 8/1981 | Wilson | 9/310 |
| 4,479,785 | 10/1984 | Tugwood et al. | 441/75 |
| 4,610,634 | 9/1986 | Kimura | 441/75 |
| 4,938,725 | 7/1990 | Beck | 441/75 |
| 4,960,063 | 10/1990 | Bontemps | 441/75 |

FOREIGN PATENT DOCUMENTS

| | | | |
|---|---|---|---|
| 8900844 | 11/1990 | Netherlands | 191/12 R |

*Primary Examiner*—Michael S. Huppert
*Assistant Examiner*—Thomas J. Brahan
*Attorney, Agent, or Firm*—Blakely, Sokoloff, Taylor & Zafman

[57] ABSTRACT

A leash for a bodyboard that includes a coil having a plurality of adjacent loops. The coil expands and contracts, so that the user can become separated from the board and still retrieve the same. The loops form a cylinder that has a longitudinal axis. The coil is attached to the bodyboard so that the longitudinal axis is perpendicular to the surface of the board. The length also has a pair of swivel joints at each end of the coil. The swivel joints are detachable so that additional coils can be added to the existing coil, thereby increasing the length of the leash.

12 Claims, 2 Drawing Sheets

FIG. 1
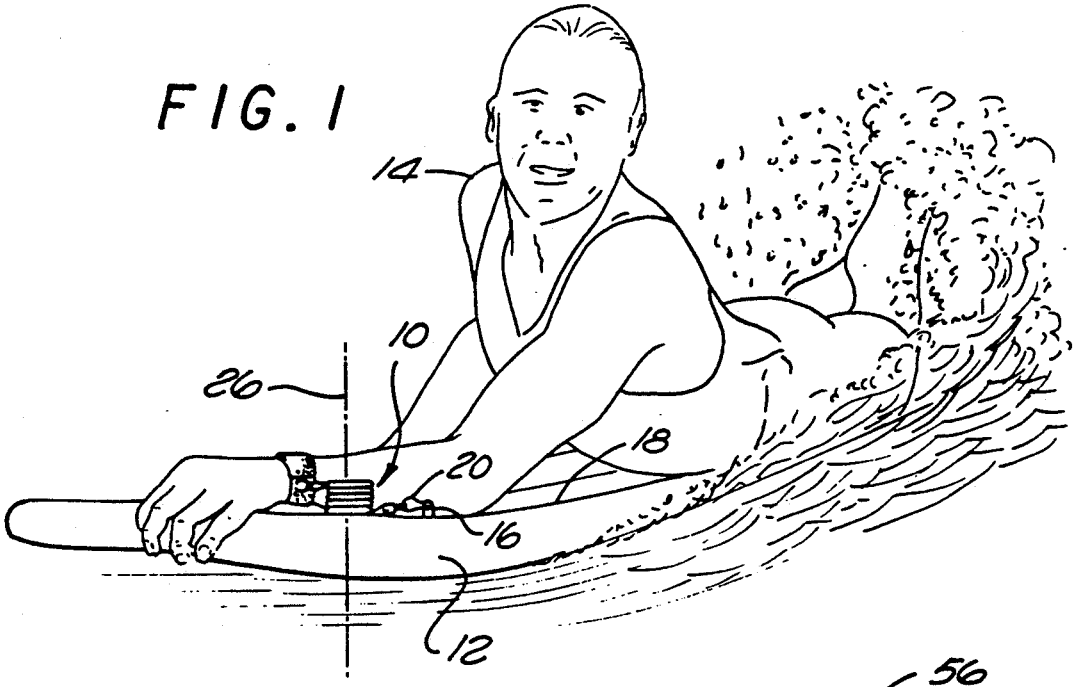
FIG. 2
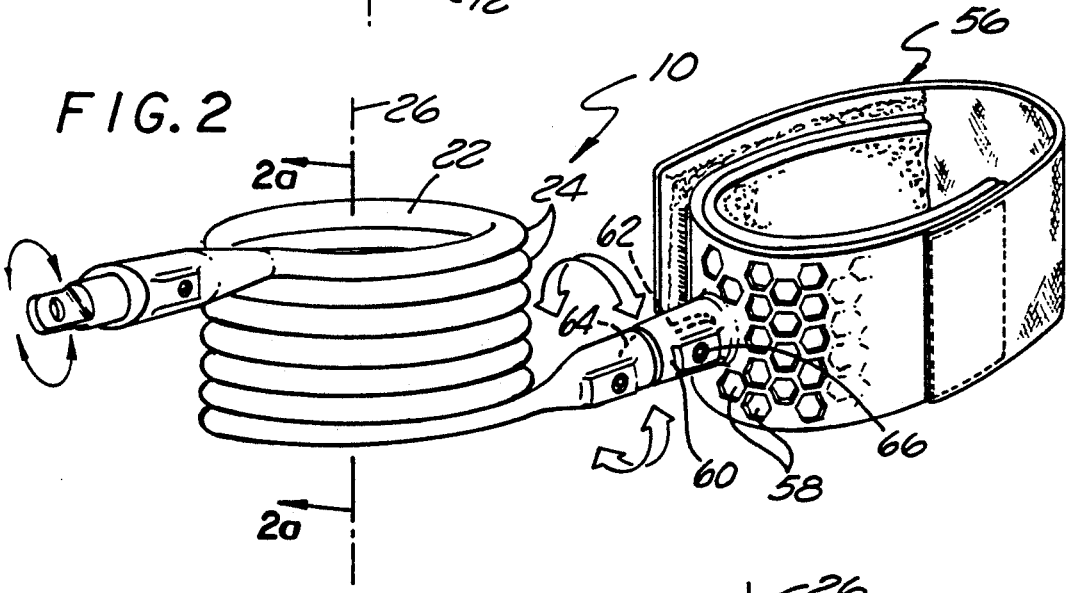
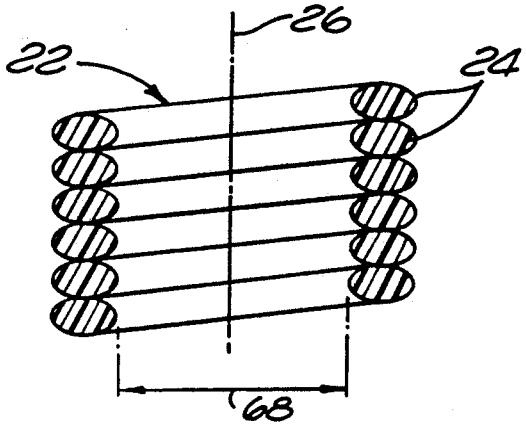
FIG. 2a

AQUATIC BODYBOARD LEASH

BACKGROUND OF THE INVENTION

1. Field of the Invention

The present invention relates to leashes used to attach a rider to a bodyboard or surfboard.

2. Description of Related Art

Bodyboards typically have a leash that allows the rider to maintain constant possession of the board. The leash usually includes a wrist strap that is coupled to the board by a cord or wire. Different wave conditions require different lengths of cord. For example, while waiting for the "perfect" wave, the rider may dive beneath the turbulence to avoid movement from the water. The board is left on the surface of the water, wherein the leash serves to prevent the board from floating away from the user. For large waves, the rider must dive particularly deep to avoid the wave turbulence. Therefore large waves typically require a longer cord.

U.S. Pat. No. 4,610,634 issued to Kimura and U.S. Pat. No. 4,041,562 issued to Nealy, disclose leashes that have a cord attached to an ankle strap. Although the cord of these devices can be long enough to use in large waves, the longer wire can become entangled with the user.

U.S. Pat. No. 4,044,415 issued to Wood, discloses a leash with an elastic member that stretches to increase the length of the cord. The Wood leash is still susceptible to entanglement and provides only limited variations in cord length.

U.S. Pat. No. 4,479,785 issued to Tugwood et al, discloses a leash with a helical cord. The cord varies in length as the user moves farther from the board. The cord extends parallel with the surface of the board and thus can still become a source of entanglement. Additionally, a rider will typically lie flat on the board while riding the waves. The rider may inadvertently lie on the cord. The thickness of the helical cord, when pinned beneath the user, can cause discomfort and pain.

Depending upon location and weather, the user may be subjected to various wave conditions. Some waves may necessitate a long leash, while other conditions may require a short leash. It would be desirable to provide a leash that can be readily attached to another leash, to quickly increase the length of the same. It would also be desirable to have a leash that can vary in length, while not being susceptible to entanglement with the user.

SUMMARY OF THE INVENTION

The present invention is a leash for a bodyboard that includes a coil having a plurality of adjacent loops. The coil expands and contracts, so that the rider can become separated from the board and still retrieve the same. The loops form a cylinder that has a longitudinal axis. The coil is attached to the bodyboard so that the longitudinal axis is perpendicular to the surface of the board. This compact coil arrangement covers less board space than cords in the art, thereby reducing the probability that the cord will become entangled or entrapped beneath the rider.

The leash also has a pair of swivel joints at each end of the coil. The swivel joints allow the coil to be easily attached to the board and a wrist strap. The swivel joints are detachable so that additional coils can be added to the existing coil, thereby increasing the length of the leash.

Therefore it is an object of this invention to provide a variable length bodyboard leash that is not subject to entanglement with the user.

It is also an object of this invention to provide a leash that allows the attachment of additional coils, to allow the user to vary the length of the leash.

It is also an object of this invention to provide a leash that allows the attachment of various straps.

BRIEF DESCRIPTION OF THE DRAWINGS

The objects and advantages of the present invention will become more readily apparent to those ordinarily skilled in the art after reviewing the following detailed description and accompanying drawings, wherein:

FIG. 1 is a perspective view of a leash attached to a bodyboard and a rider;

FIG. 2 is a perspective view of a coil and a wrist strap;

FIG. *2a* is a cross-sectional view of the coil of FIG. 2, taken at line *2a–2a;*

Figure 3:
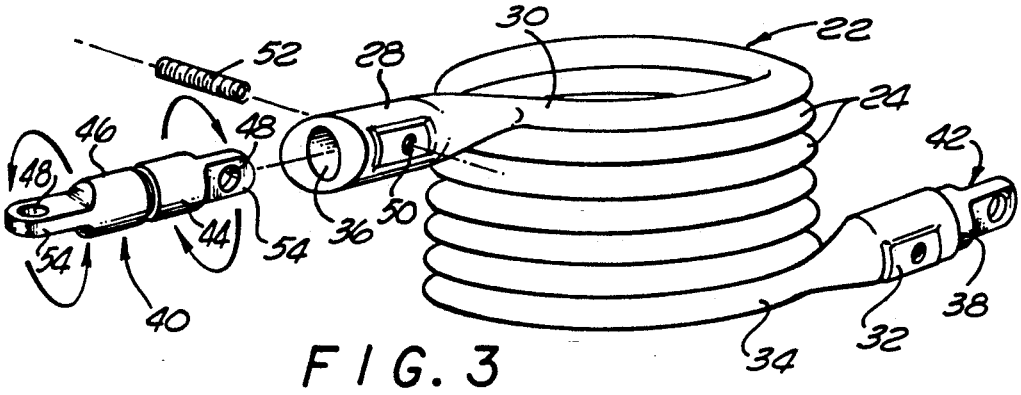
Figure 4:
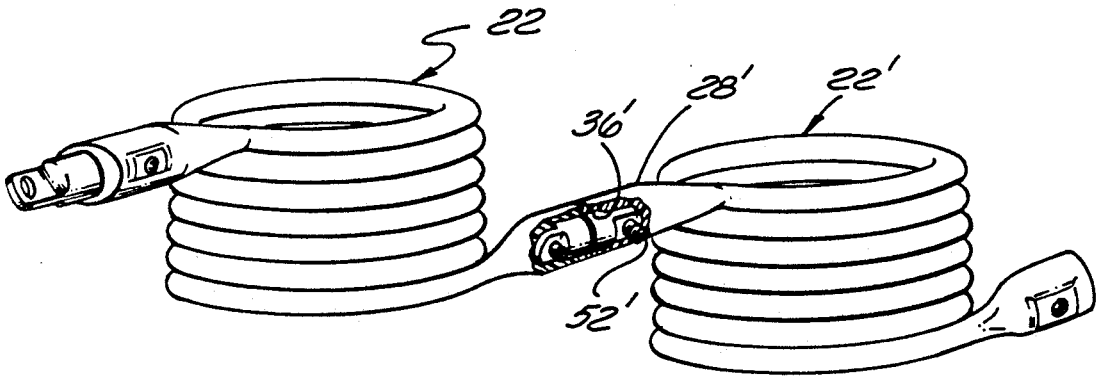
Figure 5:
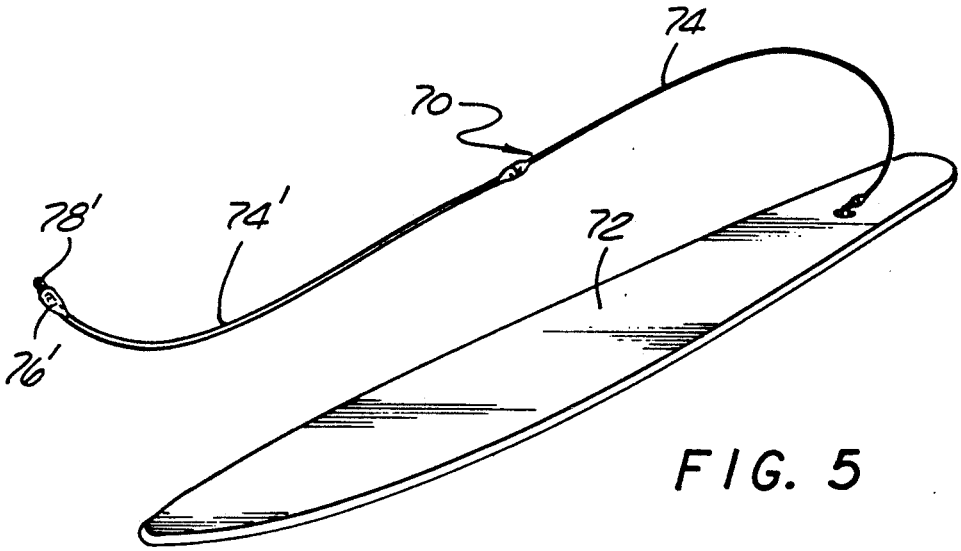

FIG. 3 is an exploded view of the coil and swivel joints;

FIG. 4 is a perspective view showing one coil being attached to another coil;

FIG. 5 is a perspective view showing one wire-leash being connected to another wire-leash.

DETAILED DESCRIPTION OF THE INVENTION

Referring to the drawings more particularly by reference numbers, FIG. 1 shows a leash 10 of the present invention attached a bodyboard 12 and a rider 14. The bodyboard 12 typically has a stud 16 extending from the surface 18 of the board and a wire or cord 20 tied to the stud 16. Although a stud 16 is described, it is to be understood that another type of attachment means may be used to connect the cord 20 to the board 12. The leash 10 couples the rider 14 to the bodyboard 12, so that the rider 14 may retrieve the board 12 in the event the two become separated.

As shown in FIG. 2, the leash 10 has a coil 22. The coil 22 has a plurality of loops 24 that are adjacent to each other. As shown in FIG. *2a*, the loops 24 preferably have an elliptical cross-section to reduce the overall height of the coil 22. The elliptical cross-section also decreases aerodynamic drag when the coil 22 is extended. The coil 22 is preferably constructed from urethane having a durometer of 55D. It has been found that 55D durometer urethane provides optimum flexibility, strength and resiliency for use in a bodyboard leash. When the board becomes separated from the rider, it is desirable to quickly pull the board back for further use. 55D durometer has been found to be resilient and strong enough to quickly pull the board back, and yet flexible enough to not shock the rider when the two become separated.

The loops 24 form a cylindrical shaped coil that has a longitudinal axis 26. As shown in FIG. 1, the coil 22 is attached to the bodyboard 12 so that the longitudinal axis 26 is perpendicular to the surface 18 of the board 12. This orientation reduces the amount of surface area occupied by the coil 22. When the rider is paddling, he is typically lying flat on the surface of the board 12. By minimizing the surface area of the coil 22, the user is less likely to lie on top of the leash. Additionally, the loops 24 are constructed to expand and contract, so that there is always tension in the coil 22. This constant tension prevents any excess coil 22 from becoming entangled with the rider 14.

As shown in FIG. 3, the coil 22 has a first housing 28 on a first end 30 of the coil and a second housing 32 on a second end 34 of the coil. The housings 28 and 32 are preferably molded with the loops 24. The integration of the housings with the coil, increases the overall strength of the leash 10. The first 28 and second 32 housings have first 36 and second 38 sockets, respectively. Attached to the housings are first 40 and second 42 swivel joints. Each swivel joint has a first portion 44 that fits within the sockets. Extending from the first portions 44 are second portions 46 that are adapted to rotate 360 degrees relative to the first portions 44 and the coil 22. Both portions of the swivel joints have apertures 48. The cord 20 can be tied to the second portion 44 of the first swivel joint 40, thereby attaching the coil 22 to the board 12.

The housings have apertures 50 that allows set screws 52 to be threaded into the housings. The screws 52 pass through the apertures 48 of the first portions 44, thereby attaching the joints to the housings and coil. The housings 28 and 32 preferably have an elliptical cross-section. The screws extend through the length of the ellipse, to provide an optimum amount of thread within the aperture 50. The apertures 50 can be self tapping, wherein the first installation of the screws create the threads within the housings. Each portion 44 and 46 of the joints may have tongues 54 formed therein. The shape of the tongues 54 match slots (not shown) formed within the sockets, to key the swivel joints with the housing. This keying feature aligns the apertures of the first portions and the housings, so that the screws can be easily inserted therein. Although set screws 52 are described and shown, it is to be understood that other attachment means may be used, such as a pin.

As shown in FIG. 2, the coil 22 is attached to a wrist strap 56. The strap 56 is constructed as one piece and preferably has hook and loop material to provide an easy means of attaching and detaching the strap 56 to the wrist of the rider. The strap 56 has a plurality of hexagonal shaped apertures 58 that reduce the weight of the strap 56, without significantly decreasing the strength of the same. Extending from the strap 56 is a housing 60 with a socket 62, aperture 64 and screw 66 as described above. The strap 56 is attached to the coil 22, by inserting the second portion 46 of the second swivel joint 42 into the socket 62 of the strap housing 60, and then screwing the set screw 66 into the housing 60 and through the aperture 48 of the second portion 46. The strap 56 is attached directly to the coil 22 without any intermediary ropes or loops. Providing the strap close to the coil, decreases the possibility of entanglement, particularly while the rider is paddling on the board.

The second portions 46 are preferably longer than the first portions 44 and the sockets, so that part of the second portion extends from the housing. With this socket/joint relationship the universal joint (not shown) of the swivel is never constrained by the housing, wherein the second portion 46 can always rotate relative to the first portion 44. This insures easy movement between the coil 22 and the strap 56, and the coil 22 and the board 12. The inner diameter 68 of the coil 22 and the width of the strap 56 are of such dimension that the strap 56 can be pulled through the coil 22. After extended use the coil 22 will sometimes obtain a semipermanent stretched position. It has been found that by pulling the strap 56 through the coil 22, the coil 22 will return to the fully retracted flattened position.

As shown in FIG. 4, a second coil 22' can be connected to the first coil 22 to increase the length of the leash 10. To connect the coils, the strap 56 is initially detached from the first coil 22. The first swivel joint (not shown) is removed from the first housing 28' of the second coil 22'. The second portion 46 of the second joint 42 of the first coil 22 is then inserted into the socket 36' of the second coil 22'. A set screw 52' is screwed into the housing 28', thereby attaching the swivel joint 42 to the housing 28' and the second coil 22' to the first coil 22. The same procedure can be used to connect additional coils, wherein the user can vary the length of the leash. Although the above process was described by removing a swivel joint from the second coil, it is to be understood that the coils can be connected in the same manner by removing the second swivel joint 42 from the first coil 22.

FIG. 5 shows another embodiment of a leash 70 that is typically used with a surfboard 72. The leash 70 incorporates a straight wire 74 instead of a coil 22. It being felt that the pull of the spring-coil 22 would be undesirable to the user of a surfboard. The wire is typically attached to an ankle strap (not shown). The ends of wire 74 have housings 76' and swivel joints 78' as described above. The swivel joints and housings allow additional wires 74' to be connected to increase the overall length of the leash 10.

While certain exemplary embodiments have been described in detail and shown in the accompanying drawings, it is to be understood that such embodiments are merely illustrative of and not restrictive on the present invention and that the invention not be limited to the specific arrangements and constructions shown and described, since various other modifications may occur to those ordinarily skilled in the art.

What is claimed is:

1. A leash for an aquatic surfcraft having a first surface, comprising:

a coil having a plurality of loops each adjacent to each other and forming a cylinder having an inner diameter and a length;, a housing integrated into said coil, each said housing having a socket that contain a swivel joint, said swivel joint having a first portion within said housing and a second portion that extends from said housing, said first and second portions each being adapted such that said second portion can rotate relative to said first portion; and, a flexible strap having an outer diameter which relative to said inner diameter and length of said coil allows said strap to be pulled through said inner diameter of said coil to reverse said coil assisting the coil in assuming a stacked cylinder orientation.

2. The leash as recited in claim 1, wherein said second portion is longer than said socket.

3. The leash as recited in claim 1, further comprising a screw that extends through apertures on said housing and said first portion to attach said swivel joint to said housing.

4. The leash as recited in claim 2, wherein said housings each have an elliptical cross-section and said screws extend through a length of said elliptical cross-section.

5. The leash as recited in claim 1, wherein said first coil is constructed from urethane having a durometer of 55D.

6. The leash as recited in claim 1, wherein said strap has a plurality of hexagonal shaped apertures.

7. A leash for an aquatic surfcraft, comprising:

a first coil having a plurality of elliptically shaped loops each adjacent to each other and defining a cylinder with an inner diameter and a length, said first coil having a first end and a second end;

a first housing integrated with said first end of said first coil, said first housing having a first socket;

a second housing integrated with said second end of said first coil, said second housing having a second socket;

a first swivel joint having a first portion within said first housing and a second portion extending from said first housing, said first and second portions each being adapted such that said second portion rotates relative to said first portion;

first swivel attachment means for attaching said first swivel joint to said first housing;

a second swivel having a first portion within said second housing and a second portion extending from said second housing, said first and second portions each being adapted such that said second portion rotates relative to said first portion;

second swivel attachment means for attaching said second swivel joint to said second housing a flexible strap having an outer diameter which relative to said inner diameter and length of said first coil allows said strap to be pulled through said inner diameter of said first coil to reverse said first coil assisting the coil in assuming a stacked cylinder orientation, said strap having an integrated housing; and, third swivel attachment means for attaching said second swivel joint to said strap housing.

8. The leash as recited in claim 7, wherein said second portion is longer than said socket.

9. The leash as recited in claim 8, wherein said first, second and third swivel attachment means include screws that extend through said housing and said swivel joints.

10. The leash as recited in claim 9, wherein said housings each have an elliptical cross-section and said screws extend through a length of said elliptical cross-section.

11. The leash as recited in claim 10, wherein said first coil is constructed from urethane having a durometer of 55D.

12. The leash as recited in claim 7, wherein said first coil has an elliptical cross-section.

* * * * *